US007202200B1

(12) United States Patent
DeLeo et al.

(10) Patent No.: US 7,202,200 B1
(45) Date of Patent: Apr. 10, 2007

(54) HARD SURFACE CLEANER WITH IMPROVED STAIN REPELLENCY COMPRISING A FLUOROPOLYMER AND A QUATERNARY AMMONIUM SURFACTANT

(75) Inventors: Malcolm A. DeLeo, Castro Valley, CA (US); Jennifer C. Julian, Castro Valley, CA (US); Maria G. Ochomogo, Danville, CA (US); Robert L. Blum, Clayton, CA (US); John J. Serrao, Antioch, CA (US); Shona L. Nelson, Livermore, CA (US)

(73) Assignee: The Clorox Company, Oakland, CA (US)

( * ) Notice: Subject to any disclaimer, the term of this patent is extended or adjusted under 35 U.S.C. 154(b) by 152 days.

(21) Appl. No.: 09/724,651

(22) Filed: Nov. 28, 2000

(51) Int. Cl.
*C11D 3/24* (2006.01)
*C11D 1/62* (2006.01)

(52) U.S. Cl. ..... 510/191; 510/238; 510/256; 510/362; 510/237; 510/384; 510/412; 510/477; 510/580; 510/504

(58) Field of Classification Search ..... 510/238, 510/191, 256, 362, 237, 384, 412, 477, 480, 510/504
See application file for complete search history.

(56) References Cited

U.S. PATENT DOCUMENTS 3,754,941 A 8/1973 Burke ..... 106/3
4,020,016 A * 4/1977 Sokol ..... 252/546
4,145,303 A 3/1979 Loudas ..... 252/156
4,409,118 A * 10/1983 Eoga ..... 252/99
4,518,520 A 5/1985 Eoga ..... 252/174
4,540,504 A 9/1985 Eoga ..... 252/99
4,847,004 A * 7/1989 McLeod ..... 252/527
5,932,328 A * 8/1999 Burke et al. ..... 428/212
6,013,323 A * 1/2000 Klayder et al. ..... 427/384
6,258,772 B1 * 7/2001 Yeggy et al. ..... 510/422
6,306,810 B1 * 10/2001 Cheung et al. ..... 510/238
6,358,909 B1 * 3/2002 Ochomogo et al. ..... 510/417

FOREIGN PATENT DOCUMENTS

CA 2201406 4/1997
WO WO 97/36979 10/1997
WO WO 97/36980 10/1997

* cited by examiner

*Primary Examiner*—Charles Boyer
(74) *Attorney, Agent, or Firm*—David Peterson; Monica Winghart

(57) ABSTRACT

The invention provides an improved, liquid aqueous hard surface cleaner containing a fluoropolymer having a molecular weight of no less than 5,000, further containing preferably a nonionic surfactant, optionally, a quaternary ammonium compound, a chelating agent/buffer and water to provide enhanced cleaning of hard surfaces, especially vitreous surfaces, in which the thus cleaned surface is rendered soil and stain repellent.

8 Claims, 9 Drawing Sheets

HARD SURFACE CLEANER WITH IMPROVED STAIN REPELLENCY COMPRISING A FLUOROPOLYMER AND A QUATERNARY AMMONIUM SURFACTANT

FIELD OF THE INVENTION

The present invention relates to an improved liquid, aqueous hard surface cleaner which, after application to a hard surface, especially a vitreous hard surface, results in enhanced stain and soil repellency of said hard surface.

BACKGROUND OF THE INVENTION

Low molecular weight fluoro compounds have been added to various cleaning compositions for various purposes. For example, Burke, U.S. Pat. No. 3,754,941, suggests the use of fluorosilicates to remove metallic stains from porcelain. Loudas, U.S. Pat. No. 4,145,303, on the other hand, suggests the use of a fluoroaliphatic carboxylic acid to impart water and oil repellency to carpet or other fabric surfaces. Nayar et al., Can. Patent 2,201,406, combines low molecular weight fluorosurfactants with a sulfonic cleaner and a rheology control agent (a thickener), as a liquid toilet bowl cleaner. In view of the relatively thin rheology of Nayar's compositions, the reference astutely teaches the necessity of incorporating a thickener. Finally, Eoga, U.S. Pat. Nos. 4,518,520 and 4,540,504, teach solid, tabletted, oxidative denture cleaners which contain water-insoluble fluorocarbon polymers, such as polytetrafluoroethylene, to dimensionally stabilize such tabletted cleaners. As a matter of fact, it was recognized in Eoga that the particular fluorocarbon polymers utilized therein would have solubility problems. In comparing its utilization of such fluorocarbon polymers versus that of the prior art, Eoga noted that it would be necessary to mix a perborate salt with the fluorocarbon polymers in order to achieve desirable solubility. (Eoga, U.S. Pat. No. 4,450,504, column 7, lines 38–61 and U.S. Pat. No. 4,518,520, column 6, line 61 to column 7, line 12.) Thus, none of the related art teach, disclose or suggest an improved liquid, aqueous hard surface cleaner which employs fluoropolymers having a molecular weight of no less than 5,000 which, after application to a hard surface, especially a vitreous hard surface, results in enhanced stain and soil repellency of said hard surface. Additionally, such related art does not teach, disclose or suggest the further advantages and benefits of the inventive aqueous hard surface cleaner containing fluoropolymers having a molecular weight of no less than 5,000.

SUMMARY OF THE INVENTION

The present invention is directed to an improved, liquid aqueous hard surface cleaner containing a fluoropolymer having a molecular weight of no less than 5,000, further containing preferably a nonionic surfactant, optionally, a quaternary ammonium compound, a chelating agent/buffer and water. The foregoing are combined to provide enhanced cleaning of hard surfaces, in which the thus cleaned surface is rendered soil and stain repellent. Surfaces treated with the improved, liquid aqueous hard surface cleaner, especially vitreous hard surfaces, such as porcelain, glazed tile surfaces, marble, granite, other stone, grout, wood, leather, glass, mirrors or other, shiny metallic surfaces (or other hard, glossy surfaces, whether made of natural or composite materials), and the like, are rendered brighter and shinier in appearance. More importantly, though, in the case of vitreous surfaces such as toilet bowls and urinals, which are subject to hard water staining due to high metal content (egs., iron and calcium, perhaps also, manganese ions) in the flush water, the inventive hard surface cleaner leaves a film or other treatment which renders such surfaces highly repellent to soils and stains, namely from such metals.

In one aspect, the invention is directed to a liquid cleaner comprising:

(a) a surfactant;

(b) a fluoropolymer having a molecular weight of no less than 5,000; and (c) the remainder, water, said cleaner rendering a hard surface cleaned therewith repellent to staining by heavy metals.

In another aspect, the invention is directed to a liquid toilet cleaner containing fluoropolymer having a molecular weight of no less than 5,000, said toilet cleaner preventing the formation of hard water stains to surfaces treated therewith.

It is therefore an object and an advantage of the present invention to provide an improved liquid cleaner which contains a surfactant, preferably such as a nonionic surfactant, a fluoropolymer having a molecular weight of no less than 5,000, and water.

It is another object and another advantage of the present invention to provide an improved liquid cleaner containing a surfactant, optionally a quaternary ammonium compound, a fluoropolymer having a molecular weight of no less than 5,000, and water.

It is yet another object and yet another advantage of the present invention to provide an improved liquid cleaner which contains a surfactant, a fluoropolymer having a molecular weight of no less than 5,000, a chelating agent/buffer (such as an acid) and water.

It is still a further object and still a further advantage of the present invention to provide a consumer convenient cleaning means which cleans vitreous surfaces, rendering them stain repellent.

It is a further object and yet further advantage of the present invention to enhance the speed of drying of the improved liquid cleaner.

It is an even further object and also further advantage of the present invention to enhance the filming and streaking attributes of the improved liquid cleaner.

It is another object and a further advantage of the present invention to provide an improved liquid cleaner which cleans hard surfaces and, especially with respect to glossy surfaces, leaves the surface clean, bright and shiny.

DETAILED DESCRIPTION OF THE INVENTION

Figure 1:
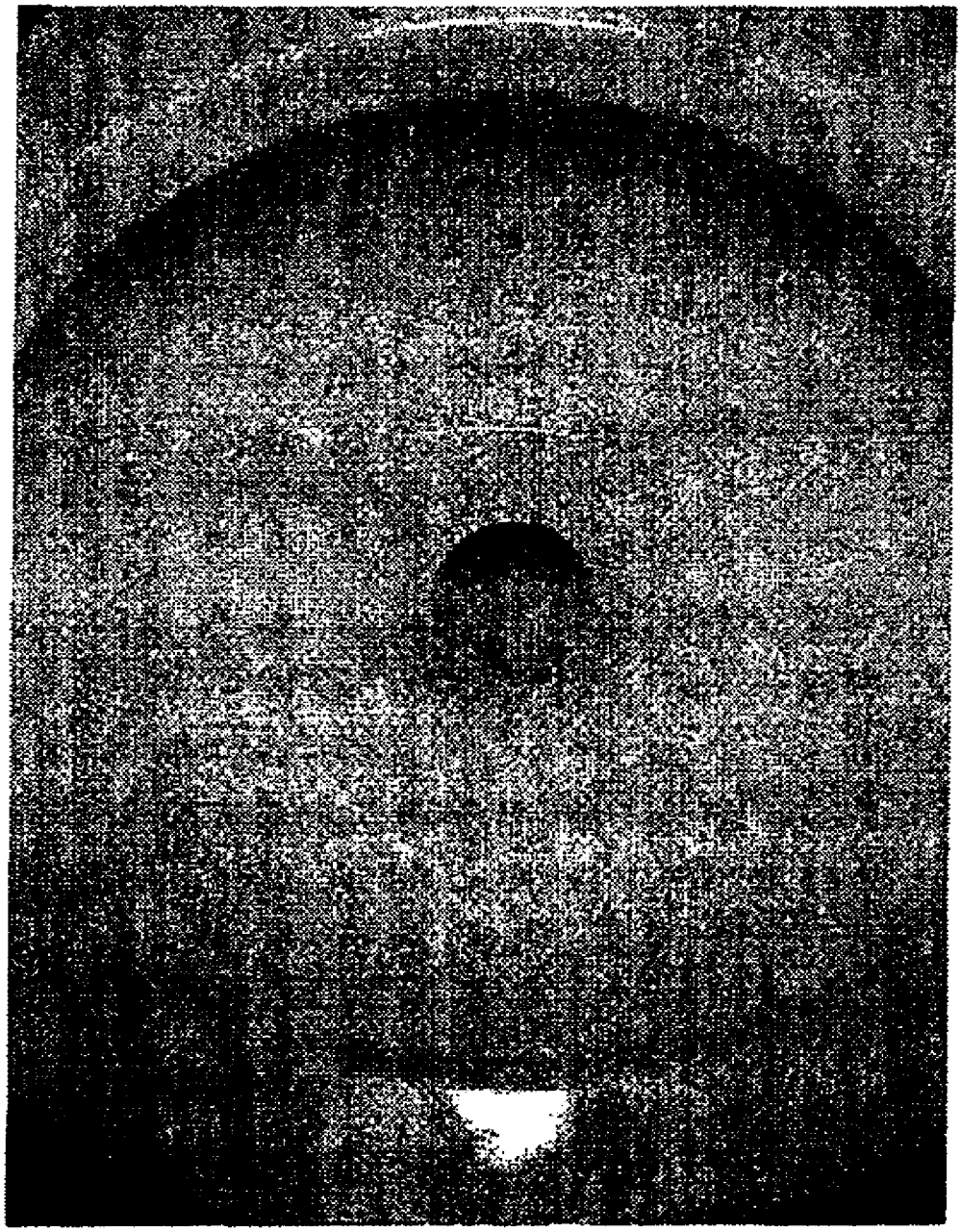
FIG. 1 is a photograph showing a clean vitreous surface (toilet bowl) after single treatment with the inventive liquid cleaner after 78 flushes.

The present invention is directed to an improved, liquid aqueous hard surface cleaner containing a fluoropolymer having a molecular weight of no less than 5,000, further containing preferably a nonionic surfactant, optionally, a quaternary ammonium compound, a chelating agent/buffer and water. The foregoing are combined to provide enhanced cleaning of hard surfaces, in which the thus cleaned surface is rendered soil and stain repellent.

In the following disclosure, percentages are by weight of ingredient on a 100% actives basis, unless otherwise indicated.

1. Fluoropolymers

As mentioned above, the fluoropolymers used in the invention are those which have a molecular weight of at least about 5,000 Daltons, more preferably at least about 10,000 Daltons. In fact, some of the polymers considered useful herein may have molecular weights upwards of 300,000 Daltons. These types of compounds are to be distinguished from the much smaller fluorosurfactants described in Nayar et al., Can. Patent 2,201,406. It is speculated that, in the invention, the applicable fluoropolymers, do not completely replace the aliphatic hydrogens with fluoride, as in polytetrafluoroethylene. Alternatively, it is believed that the fluoropolymers must be at least partially substituted with water solubilizing groups, such as, without limitation, carboxyl, amido, sulfonato, ethoxyl, propoxyl and the like. It is thus believed that the fluoropolymers must be at least water-dispersible, and preferably, are at least sparingly water-soluble. These types of fluoropolymers include fluorinated substituted urethanes (such as Zonyl® 7910 from E.I. du Pont de Nemours and Co., hereinafter, "DuPont"), and perfluoroalkylmethacrylic copolymers (such as such as Zonyl® 8740 from DuPont. Pertinently, because these compounds are fluoropolymers, they will enhance the rheology of the liquid cleaners of the invention and will not require additional thickeners, as in Can. Patent 2,201,406. Moreover, after application to a stained surface, such as toilet with hard water or heavy metal stains, the cleaner not only cleans the stains, but the fluoropolymers in the cleaner beneficially appear to lay down a film which repels, prevents or mitigates further staining due to the hard water. This is a significant and surprising benefit of the inventive cleaner. The amount of fluoropolymer should be added preferably in amounts of about 0.01 to 25% by weight, more preferably about 0.01 to about 15% by weight, and most preferably, about 0.01 to about 5% by weight. The addition should be relatively sparing (owing to its costs), and so amounts as low as up to 2.5% are especially favored.

2. Surfactants

A further key part of the invention lies in the use of surfactants, such as, without limitation, nonionic, anionic, cationic or amphoteric surfactants, or mixtures thereof, such as are known in the art. Such surfactants are described, for example, in *McCutcheon's Emulsifiers and Detergents* (1997), the contents of which are hereby incorporated by reference.

Illustrative nonionic surfactants are the semi-polar nonionics known as amine oxides, and other nonionics, such as, ethylene oxide and mixed ethylene oxide/propylene oxide adducts of alkylphenols, ethoxylated, propoxylated and ethoxylated/propoxylated alcohols, the ethylene oxide and mixed ethylene oxide/propylene oxide adducts of long chain alcohols or of fatty acids, mixed ethylene oxide/propylene oxide block copolymers, esters of fatty acids and hydrophilic alcohols, such as sorbitan monooleate, alkanolamides, alkylpolyglycosides and alkylpolyglucosides, alkylpyrrolidones (which may also be considered solvents (see 6. below) and the like.

Illustrative anionic surfactants are the soaps, alkylbenzene sulfonates, olefin sulfonates, paraffin sulfonates, alcohol and alcohol ether sulfates, phosphate esters, and the like.

Illustrative cationic surfactants include aminesalkylamine ethoxylates, ethylenediamine alkoxylates such as the Tetronic® series from BASF, quaternary ammonium salts, and the like. However, certain quaternary ammonium compounds perform as antimicrobials and a separate description of them follows in 3. below.

Illustrative amphoteric surfactants are those which have both acidic and basic groups in their structure, such as amino and carboxyl radicals or amino and sulfonic radicals, or amine oxides and the like. Suitable amphoteric surfactants include betaines, sulfobetaines, imidazolines, and the like.

In the invention, the amine oxides are preferred as surfactants. The amine oxides, referred to as mono-long chain, di-short chain, trialkyl amine oxides, have the general configuration:

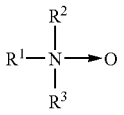

wherein $R^1$ is $C_{6-24}$ alkyl, and $R^2$ and $R^3$ are both $C_{1-4}$ alkyl, or $C_{1-4}$ hydroxyalkyl, although $R^2$ and $R^3$ do not have to be equal.

These amine oxides can also be ethoxylated or propoxylated. The preferred amine oxide is lauryl amine oxide. The commercial sources for such amine oxides are Barlox 10, 12, 14 and 16 from Lonza Chemical Company, Varox by Witco and Ammonyx by Stepan Company.

A further semi-polar nonionic surfactant is alkylamidoalkylenedialkyl-amine oxide. Its structure is shown below:

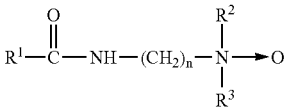

wherein $R^1$ is $C_{5-20}$ alkyl, $R^2$ and $R^3$ are $C_{1-4}$ alkyl,

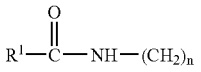

—or —$(CH_2)_p$—OH, although $R^2$ and $R^3$ do not have to be equal or the same substituent, and n is 1–5, preferably 3, and p is 1–6, preferably 2–3. Additionally, the surfactant could be ethoxylated (1–10 moles of EO/mole) or propoxylated (1–10 moles of PO/mole). This surfactant is available from various sources as a cocoamidopropyldimethyl amine oxide; it is sold by Lonza Chemical Company under the brand name Barlox C. Additional semi-polar surfactants may include phosphine oxides and sulfoxides.

Yet further preferred nonionic surfactants are alkylpolyglycosides, which are generally referred to as APG's or glycosides. The preferred glycosides include those of the formula:

$$RO(C_nH_{2n}O)_y(Z)_x$$

wherein R is a hydrophobic group (e.g., alkyl, aryl, alkylaryl etc., including branched or unbranched, saturated and unsaturated, and hydroxylated or alkoxylated members of the foregoing, among other possibilities) containing from about 6 to about 30 carbon atoms, preferably from about 8 to about 16 carbon atoms, and more preferably from about 8 to about 12 carbon atoms; n is a number from 2 to about 4, preferably 2 (thereby giving corresponding units such as ethylene, propylene and butylene oxide); y is a number having an average value of from 0 to about 12, preferably 0; Z is a moiety derived from a reducing saccharide containing 5 or 6 carbon atoms (e.g., a glucose, fructose, mannose, galactose, talose, gulose, allose, altrose, idose, arabinose, xylose, lyxose, or ribose unit, etc., but most preferably a glucose unit); and x is a number having an average value of from 1 to about 10, preferably from 1 to about 5, and more preferably from 1 to about 3. In actual practice, R may be a mixture of carbon chains, for instance, from 8 to 16 carbon atoms and Z may be a mixture of saccharide units from 0 to 6.

It would be apparent that a number of variations with respect to the makeup of the glycosides are possible. For example, mixtures of saccharide moieties (Z) may be incorporated into polyglycosides. Also, the hydrophobic group (R) can be attached at the 2-, 3-, or 4-positions of a saccharide moiety rather than at the 1-position (thus giving, for example, a glucosyl as opposed to a glucoside). In addition, normally free hydroxyl groups of the saccharide moiety may be alkoxylated or polyalkoxylated. Further, the $(C_nH_{2n}O)_y$ group may include ethylene oxide and propylene oxide in random or block combinations, among a number of other possible variations.

Non-limiting examples of glycoside surfactants include Glucopon 225 (a mixture of $C_8$ and $C_{10}$ chains equivalent to an average of $C_{9.1}$, with x of the general formula above of 1.7, and an HLB of 13.6; Glucopon 220 (a mixture of $C_8$ and $C_{10}$ chains equivalent to an average of $C_{9.1}$, with x of the general formula above of 1.5, and an HLB of 13.5; Glucopon 325 (a mixture of $C_8$, $C_{10}$, $C_{12}$, $C_{14}$, and $C_{16}$ chains equivalent to an average of $C_{10.2}$, with x of the general formula above of 1.6, and an HLB of 13.1; Glucopon 625 (a mixture of $C_{12}$, $C_{14}$, and $C_{16}$ chains equivalent to an average of $C_{1.28}$, with x of the general formula above of 1.60, and an HLB of 12.1; and Glucopon 600 (a mixture of $C_{12}$, $C_{14}$, and $C_{16}$ chains equivalent to an average of $C_{12.8}$, with x of the general formula above of 1.40, and an HLB of 11.5, all manufactured by the Henkel Corporation. Of these, Glucopon 225 and Glucopon 220 are preferred and Glucopon 425 is especially preferred. Glucosides from other manufacturers, such as Triton CG-110, having an HLB of 13.6 and manufactured by Union Carbide also may serve as examples of suitable surfactants.

Glucoside surfactants are frequently supplied as mixtures with other surfactants. For example, mixtures with the anionic surfactants, lauryl sulfate or laurylether sulfate, or the amphoteric surfactants, cocamidopropylbetaine or cocamidopropyl amineoxide, are available from the Henkel Corporation.

It may be suitable to employ amphoteric surfactants in the invention. An amphoteric is typically an alkylbetaine, an amidobetaine, or a sulfobetaine. One group of preferred amphoterics are alkylamidoalkyl-dialkylbetaines. These have the structure:

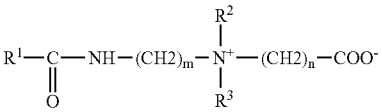

wherein $R_1$ is $C_{6-20}$ alkyl, $R^2$ and $R^3$ are both $C_{1-4}$ alkyl, although $R^2$ and $R^3$ do not have to be equal, and m can be 1–5, preferably 3, and n can be 1–5, preferably 1. These alkylbetaines can also be ethoxylated or propoxylated. The preferred amidobetaine is cocoamidopropyldimethyl betaine, available from Lonza Chemical Co. as Lonzaine CO. Other vendors are Henkel KGaA, which provides Velvetex AB, and Witco Chemical Co., which offers Rewoteric AMB-15, both of which products are cocobetaines.

Potentially suitable zwitterionic surfactants can be found described in Jones, U.S. Pat. No. 4,005,029, at columns 11–15, which are incorporated herein by reference.

The amounts of surfactants present are generally about 0.001–25%, more preferably 0.001–5% surfactant. These are generally considered to be dispersion-effective amounts.

3. Quaternary Ammonium Compound

A third, optional, but very desirable, component of the invention is a quaternary ammonium compound, or surfactant. These types of surfactants are typically used in bathroom cleaners because they are generally considered "broad spectrum" antimicrobial compounds, having efficacy against both gram positive (e.g., *Staphylococcus* sp.) and gram negative (e.g., *Escherichia coli* or *Klebsiella* A) microorganisms. Thus, the quaternary ammonium surfactant, or compounds, are incorporated for bacteriostatic/disinfectant purposes and should be present in amounts effective for such purposes.

The quaternary ammonium compounds are selected from mono-long-chain, tri-short-chain, tetraalkyl ammonium compounds, di-long-chain, di-short-chain tetraalkyl ammonium compounds, trialkyl, mono-benzyl ammonium compounds, and mixtures thereof. By "long" chain is meant about $C_{6-30}$ alkyl. By "short" chain is meant about $C_{1-5}$ alkyl, preferably $C_{1-3}$ Suitable counterions for such quaternary ammonium compounds include halides (chlorides, bromides, iodides), hydroxides, saccharinates, carbonates, phosphates, phosphonates, sulfates, bisulfates, alkylsulfates, carboxylates, and other negatively charged counterions.

Preferred materials include the BTC 885—which comprises a mixture of $C_{12-6}$ alkyl dimethylbenzyl ammonium chloride, $C_8/C_{10}$ alkyl dimethyl ammonium chloride, di-$C_8$ alkyl dimethyl ammonium chloride, and di-$C_{10}$ alkyl dimethyl ammonium chloride—and 2125 series from Stepan, which comprises di-$C_{24}$-dialkyl ammonium chloride, and the Barquat and Bardac series, such as Bardac MB 205M, from Lonza Chemical. Most preferred appears to be a mixed quaternary ammonium surfactant in which there is a combination of di-long-chain, di-short-chain tetraalkyl ammonium compounds, and trialkyl, mono-benzyl ammonium compounds. These particularly preferred quaternary ammonium surfactants are the most effective at broad spectrum contact and residual antimicrobial efficacy (both gram negative and gram positive microorganisms), antifingal and antiviral efficacy. Typical amounts of the quaternary ammonium compound range from preferably about 0.01–5%, more preferably about 0.01–2%. One could also use the mildewstats and bacteriostats listed in 7. below, as other or further antimicrobials (i.e., as alternatives to, or potentiators for, antimicrobials).

4. Buffer/Chelating Agent

The chelating agent is also an important part of the invention. Chelants useful herein include the various alkali metal, ammonium and substituted ammonium polyacetates, carboxylates, polycarboxylates and polyhydroxysulfonates. Most preferred is citric acid. Non-limiting examples of polyacetate and polycarboxylate builders include the sodium, potassium, lithium, ammonium and substituted ammonium salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. Stronger inorganic acids, such as hydrochloric, sulfuric, sulfonic, hydroxysulfamic, may also be suitable. In general, if a toilet cleaning product is desired, it will usually be acidic since these types of products are most effective against the types of mineral stains commonly found on such surfaces. Chelating agents may also exist either partially or totally in the hydrogen ion form, for example, citric acid or disodium dihydrogen ethylenediamine tetraacetate. The substituted ammonium salts include those from methylamine, dimethylamine, butylamine, butylenediamine, propylamine, triethylamine, trimethylamine, monoethanolamine, diethanolamine, triethanolamine, isopropanolamine, and propanolamine.

Other chelating agents, and dependent on the desired pH of the formulation (see below), are the mono-, di-, tri-, and tetrapotassium and ammonium salts of ethylenediamine tetraacetic acid. See, for example, Robbins et al., U.S. Pat. No. 5,972,876, Chang et al., U.S. Pat. No. 5,948,742, Ochomogo et al., U.S. Pat. No. 5,948,741, and Mills et al., U.S. Pat. No. 5,814,591.

The amount of chelant added should be in the range of 0.001–30%, more preferably 0.001–10%, by weight of the cleaner.

5. Water

Since the cleaner is an aqueous cleaner with relatively low levels of actives, the principal ingredient is water, which should be present at a level of at least about 50%, more preferably at least about 70%, and most preferably, at least about 90%.

Distilled, deionized, or industrial soft water is preferred so as not to contribute to formation of a residue and to avoid the introduction of undesirable metal ions.

6. Solvents

A solvent may optionally be used which is generally a water soluble or dispersible organic solvent having a vapor pressure of at least 0.001 mm Hg at 25° C. A key attribute is that it should volatilize rapidly, such that it volatilizes no more than 5 minutes after contact with a surface, without leaving a residue. It is preferably selected from $C_{1-6}$ alkanols, $C_{1-6}$ diols, $C_{1-6}$ alkyl ethers of alkylene glycols and polyalkylene glycols, and mixtures thereof. The alkanol can be selected from methanol, ethanol, n-propanol, isopropanol, the various positional isomers of butanol, pentanol, and hexanol, and mixtures of the foregoing. It may also be possible to utilize in addition to, or in place of, said alkanols, the diols such as methylene, ethylene, propylene and butylene glycols, and mixtures thereof, and including polyalkylene glycols.

Straight or branched chain alkanol can be used in the invention. These are methanol, ethanol, n-propanol, isopropanol, and the various positional isomers of butanol, pentanol, and hexanol. One can also use a mixture of an alkanol with a glycol ether, in which the ratio of the two components is about 100:1 to 1:10. One can also use an alkylene glycol ether solvent in this invention. The alkylene glycol ether solvents can be used alone or in addition to the polar alkanol solvent. These can include, for example, monoalkylene glycol ethers such as ethylene glycol monopropyl ether, ethylene glycol mono-n-butyl ether, propylene glycol monopropyl ether, and propylene glycol mono-n-butyl ether, and polyalkylene glycol ethers such as diethylene glycol monoethyl or monopropyl or monobutyl ether, di- or tri-polypropylene glycol monomethyl or monoethyl or monopropyl or monobutyl ether, etc., and mixtures thereof. Additionally, acetate and propionate esters of glycol ethers can be used. Preferred glycol ethers are diethylene glycol monobutyl ether, also known as 2-(2-butoxyethoxy) ethanol, sold as Butyl Carbitol by Union Carbide, ethylene glycol monobutyl ether, also known as butoxyethanol, sold as Butyl Cellosolve also by Union Carbide, and also sold by Dow Chemical Co., propylene glycol monopropyl ether, available from a variety of sources, and propylene glycol methyl ether, sold by Dow as Dowanol PM. Another preferred alkylene glycol ether is propylene glycol t-butyl ether, which is commercially sold as Arcosolve PTB, by Arco Chemical Co. Dipropylene glycol n-butyl ether ("DPNB") is also preferred.

Short chain carboxylic acids, such as acetic acid, glycolic acid, lactic acid and propionic acid are also potential solvents, although their strong odor may require mitigation with a fragrance. Short chain esters, such as glycol acetate, or cyclic or linear volatile methylsiloxanes (such as from Dow Corning), may also be suitable for use.

Additional water insoluble solvents may be included in minor amounts (0–1%). These include isoparafinic hydrocarbons, mineral spirits, alkylaromatics, and terpenes such as d-limonene and pine oil (many of the terpene derivatives and pine oil are quite aromatic and can further be used as fragrances. In addition, they also appear to act as antimicrobials). Additional water soluble solvents may be included in minor amounts (0–2%). These include pyrrolidones, such as N-methyl-2-pyrrolidone, N-octyl-2-pyrrolidone and N-dodecyl-2-pyrrolidone.

It is preferred to limit the total amount of solvents to preferably no more than about 20%, and more preferably, no more than about 10%, of the cleaner. These amounts of solvents are generally referred to as dispersion-effective or solubilizing-effective amounts. The solvents, especially the glycol ethers, are also important as cleaning materials on their own, helping to loosen and solubilize greasy or oily soils from surfaces cleaned.

7. Miscellaneous Adjuncts

Buffering and pH adjusting agents may be desirable components. These would include minute amounts of inorganic agents such as alkali metal and alkaline earth salts of silicate, metasilicate, borate, carbonate, carbamate, phosphate, ammonia, and hydroxide. Organic buffering agents such as monoethanolamine, monopropanolamine, diethanolamine, dipropanolamine, triethanolamine, and 2-amino-2-methylpropanol are also desirable.

Small amounts of adjuncts can be added for improving aesthetic qualities of the invention. Aesthetic adjuncts include fragrances or perfumes, such as those available from Givaudan-Rohre, International Flavors and Fragrances, Quest, Sozio, Firmenich, Dragoco, Norda, Bush Boake and Allen and others, and dyes or colorants which can be solubilized or suspended in the formulation. Further solubilizing materials, such as hydrotropes (e.g., water soluble salts of low molecular weight organic acids such as the sodium or potassium salts of xylene sulfonic acid), may also be desirable. Adjuncts for cleaning include additional surfactants, such as those described in *Kirk-Othmer, Encyclopedia of Chemical Technology,* 3rd Ed., Volume 22, pp. 332–432 (Marcel-Dekker, 1983), and *McCutcheon's Soaps and Detergents* (N. Amer. 1984), which are incorporated herein by reference. Dyes or colorants which can be solubilized or suspended in the formulation, such as diaminoanthraquinones, may be added, although it is cautioned that since leaving little or no residue is an objective of the invention, that only minute amounts should be used. Thickeners, such as polyacrylic acid, xanthan gum, alginates, guar gum, hydroxyalkyl—ie., methyl, ethyl and propylcelluloses, and the like, may be desired additives, although the use of such polymers is not actually deemed necessary. If such polymers are desired for inclusion, then acidic polymers, or those stable in acid media, are preferred, such as, without limitation, xanthan gum, carboxymethylcellulose and the hydroxyalkylcelluloses.

The amounts of these aesthetic adjuncts should be in the range of 0–2%, more preferably 0–1%.

Additionally, because the surfactants in liquid systems are sometimes subject to attack from microorganisms, it is advantageous to add a mildewstat or bacteriostat. Exemplary mildewstats (including non-isothiazolone compounds) include Kathon GC, a 5-chloro-2-methyl-4-isothiazolin-3-one, Kathon ICP, a 2-methyl-4-isothiazolin-3-one, and a blend thereof, and Kathon 886, a 5-chloro-2-methyl-4-isothiazolin-3-one, all available from Rohm and Haas Company; Bronopol, a 2-bromo-2-nitropropane 1,3-diol, from Boots Company Ltd.; Proxel CRL, a propyl-p-hydroxybenzoate, from ICI PLC; Nipasol M, an o-phenyl-phenol, $Na^+$ salt, from Nipa Laboratories Ltd.; Dowicide A, a 1,2-benzoisothiazolin-3-one, from Dow Chemical Co.; and Irgasan DP 200, a 2,4,4'-trichloro-2-hydroxydiphenylether, from Ciba-Geigy A. G. See also, Lewis et al., U.S. Pat. No. 4,252,694 and U.S. Pat. No. 4,105,431, incorporated herein by reference. Chlorhexidine, nerolidol and other materials which can function as antimicrobials by themselves, or which potentiate other antimicrobials, are also included herein. Other suitable preservatives include methyl, ethyl and propyl parabens, short chain organic acids (such as acetic, lactic and glycolic acids), bisguanidine compounds (e.g., Dantagard or Glydant) and the short chain alcohols mentioned in 8. above can be bifunctional and also act as preservatives, such as ethanol and IPA.

8. Executions/Formulations

The inventive cleaner may be executed/formulated as an emulsion, suspoemulsion, liquid crystal, isotropic system, structured liquid, foam, gel, paste, mull or other liquid phase, and delivered via an appropriate means, for example, via sprayer, doser, pumptainer, dispenser, or the like, or in unit dosages, without limitation.

EXPERIMENTAL

In the following experiments, a base inventive liquid cleaner was established. The formulation of the liquid cleaner was:

TABLE I

| Ingredient | Wt. % |
|---|---|
| Citric Acid[1] | 5.0% |
| Amine Oxide[2] | 0.20% |
| Fluoropolymer[3] | 0.1% |
| Quaternary Ammonium Compound[4] | 0.5% |
| Fragrance | 0.30% |
| Deionized Water | (balance) |

[1]Chelant/buffer
[2]nonionic surfactant (Stepan Company)
[3]Zonyl 8740 (DuPont)
[4]Bardac 205M (Lonza)

The formulation of TABLE I was then tested for cleaning and, especially, for conditioning of, a vitreous surface (toilet bowl), such that restaining by hard water would be mitigated or prevented. The Invention was tested versus a commercially available product known as Vanish Brush Free (S. C. Johnson and Son, Inc.), as well as against no added cleaner/treatment (referred to as a "Spike"). These were all compared to a clean toilet bowl which would be flushed with softened water.

In these experiments, a series of ultra low flush toilets (tank capacity about 12 liters, bowl capacity about 1.8 liters) with standard flush mechanisms were arrayed in series. Each toilet was connected to an external container which fed water (whose hardness could be controlled) and was also connected to a drain conduit, to drain flushed water. The external containers were controlled via a control panel and microprocessor with a timer which would control the intermittent flushing of the toilets. In simulating the flushing cycles of standard U.S. households, 78 flushes was the equivalent of a seven day usage pattern, while 108 was the equivalent of a ten day usage pattern. To model the type of hard water which is typically found, for example, in the Midwestern U.S., the containers feeding the water into the toilets delivered about 70 ppm $CaCO_3$, and 3.0 ppm Fe ions, per flush/dose. To simulate typical stains, the $CaCO_3$ was metered directly into the bowl of the toilet. On the other hand, to simulate iron stains, the Fe was metered via the overflow tube of the toilet tank, which if the stain formed, would result in the typical "rays" of reddish stains down the sides of the bowl.

The results are dramatically depicted in the color photographs appended as FIGS. 1–9. FIGS. 1–5 depicted a 78 flush cycle, or simulated 7 day usage pattern. FIGS. 6–9 depicted a 108 flush cycle, or simulated 10 day usage pattern. Additionally, the following observations are made with respect to each color photograph:

TABLE II

Figure 2:
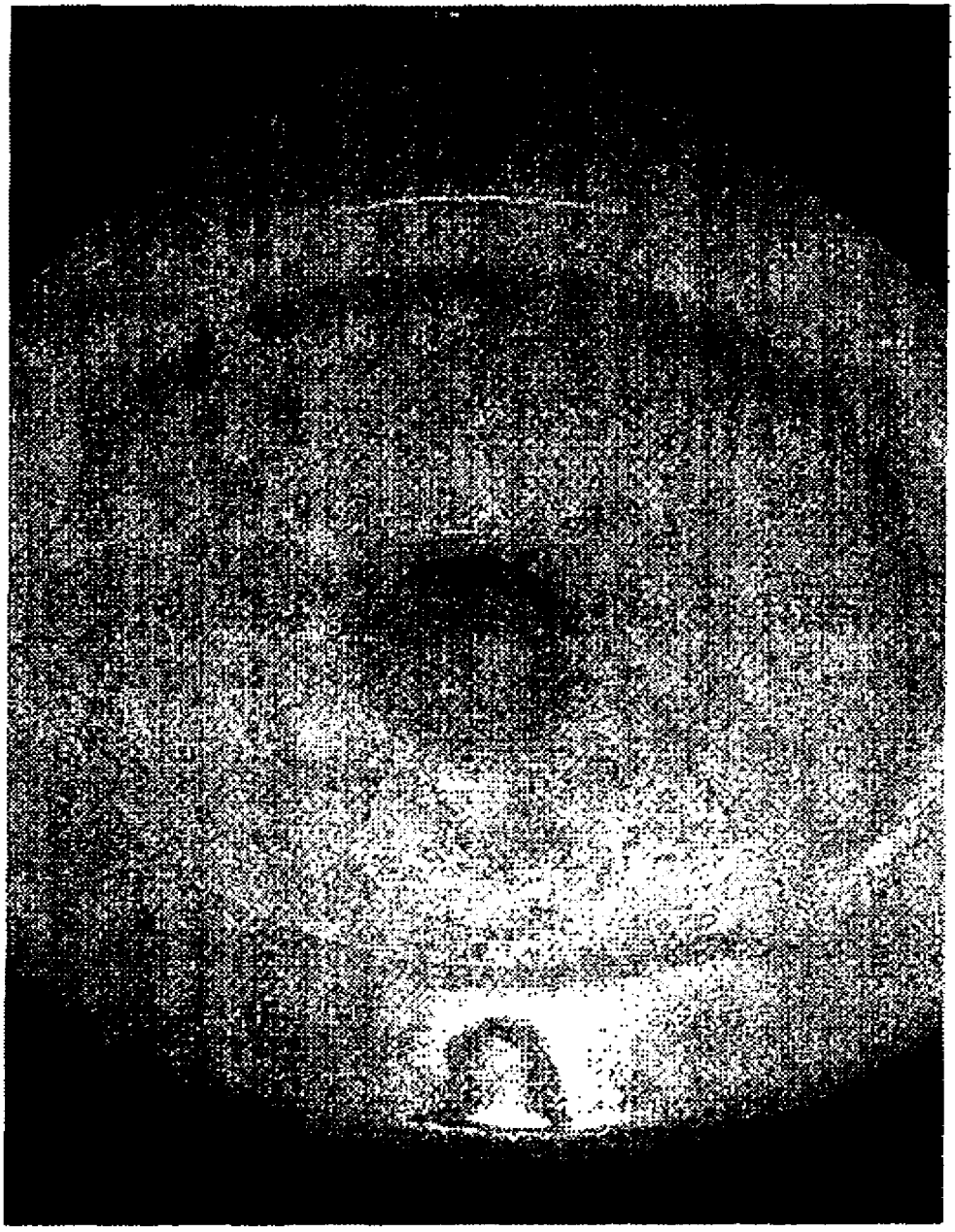
FIG. 2 is a photograph showing a iron stained vitreous surface (toilet bowl) after no treatment (Spike) after 78 flushes.
Figure 3:
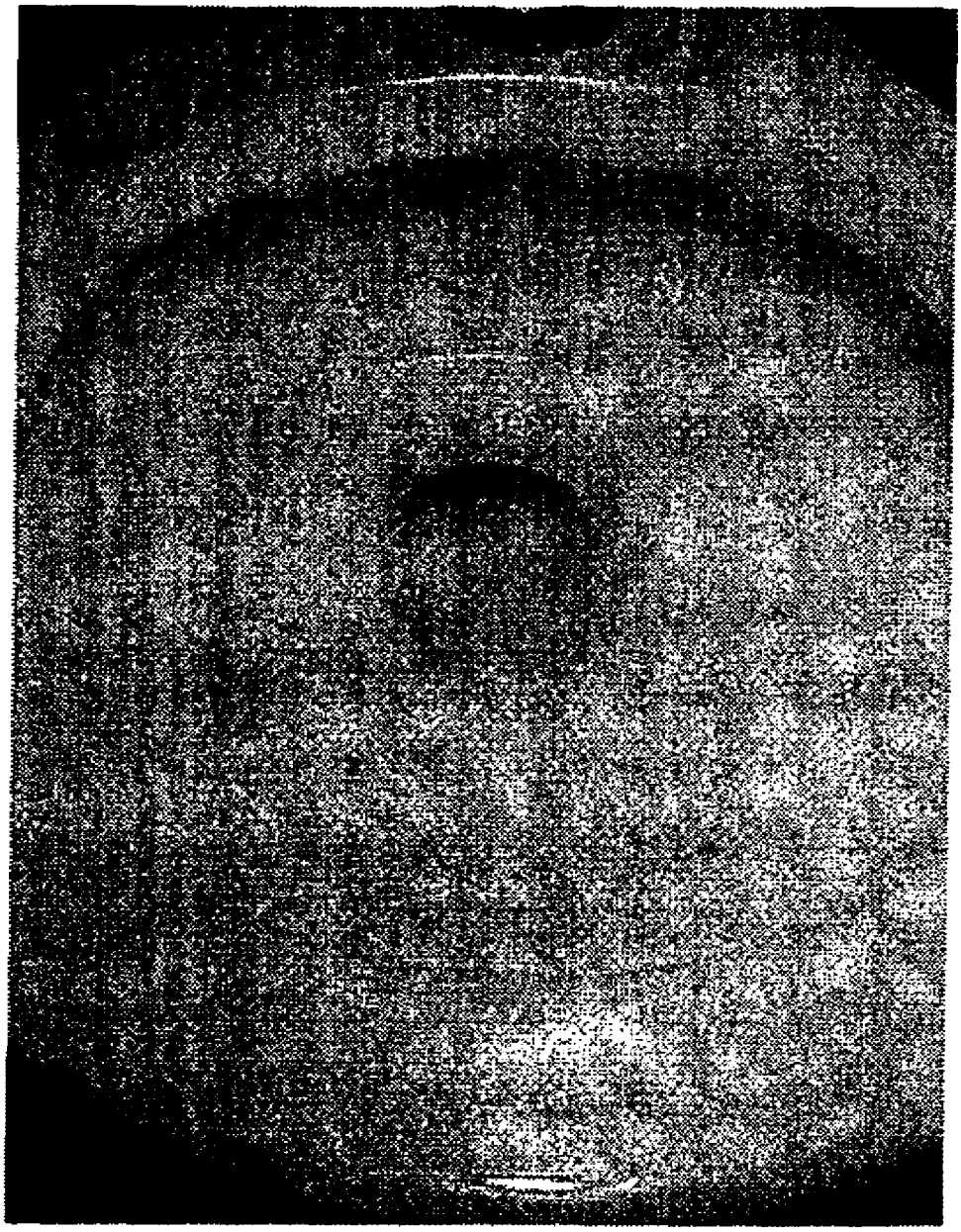
FIG. 3 is a photograph showing an iron stained vitreous surface (toilet bowl) after yet another treatment with a commercial toilet bowl cleaner after 78 flushes.
Figure 4:
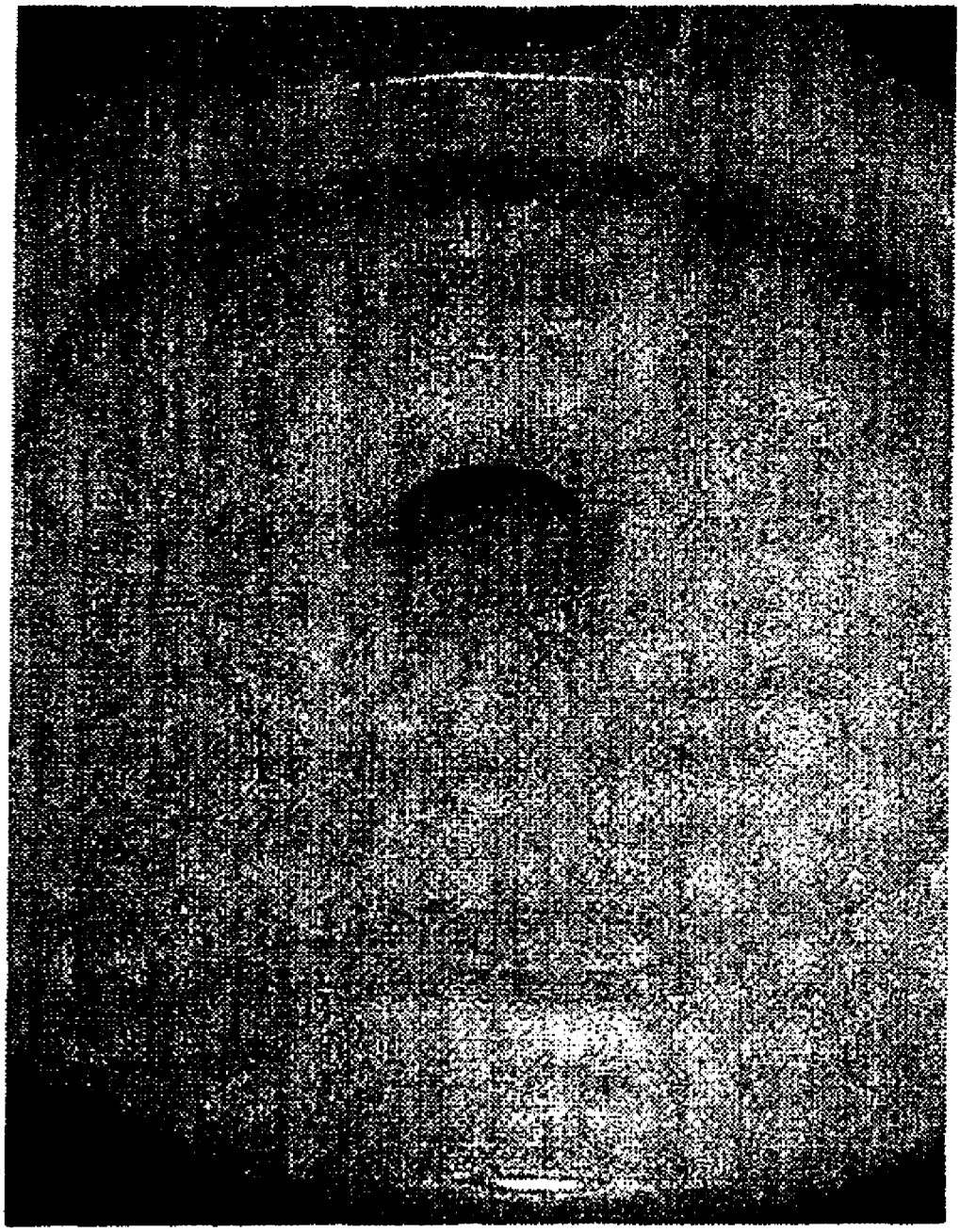
FIG. 4 is a photograph showing a clean vitreous surface (toilet bowl) after 78 flushes, in which the flush water has been softened and no treatment has occurred (Control).
Figure 5:
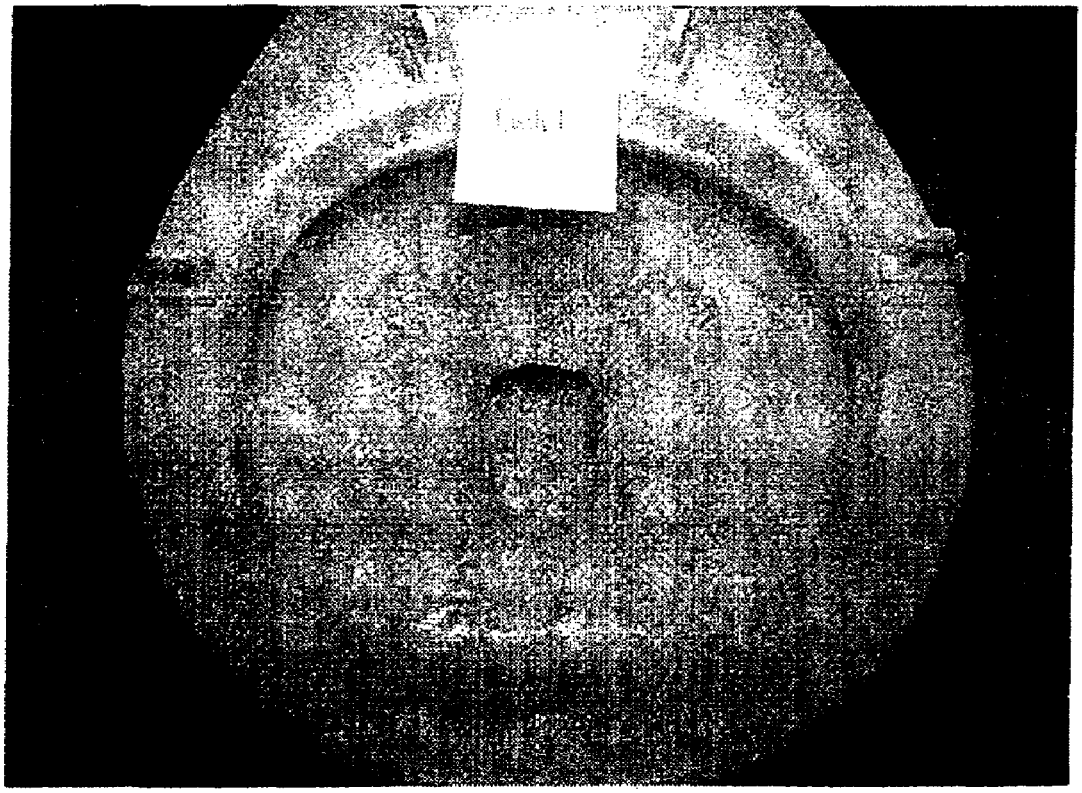
FIG. 5 is a photograph showing a clean vitreous surface (toilet bowl) after single treatment with the inventive liquid cleaner after 108 flushes.
Figure 6:
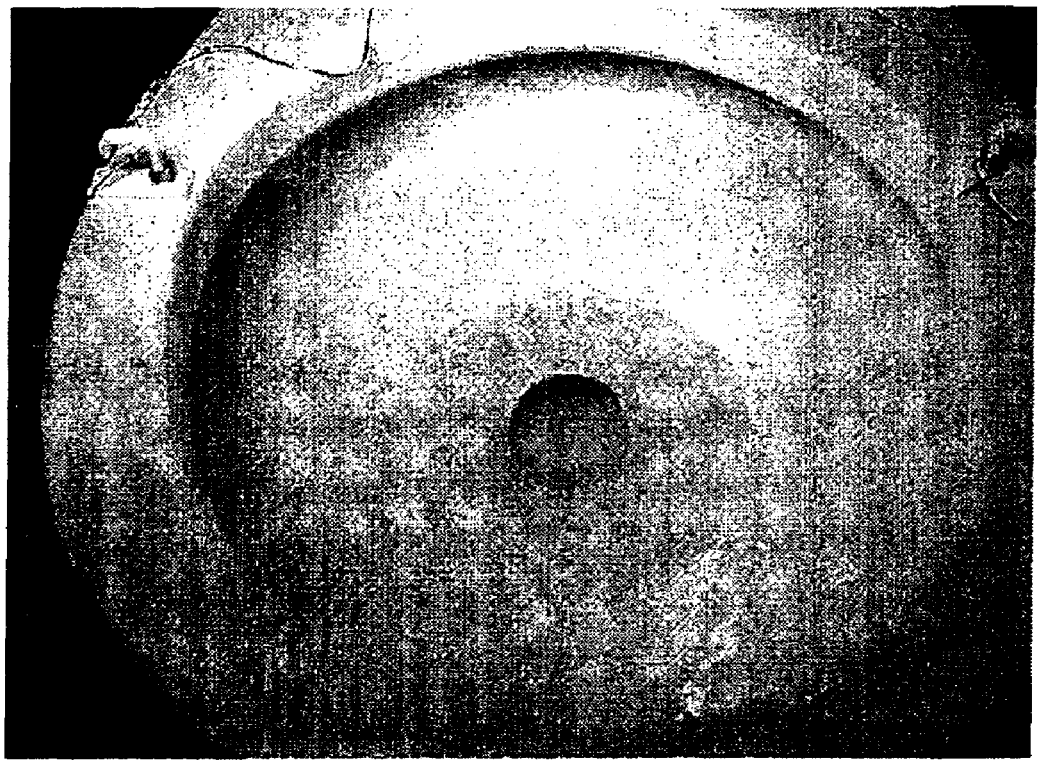
FIG. 6 is a photograph showing an iron stained vitreous surface (toilet bowl) after no treatment (Spike) after 108 flushes.
Figure 7:
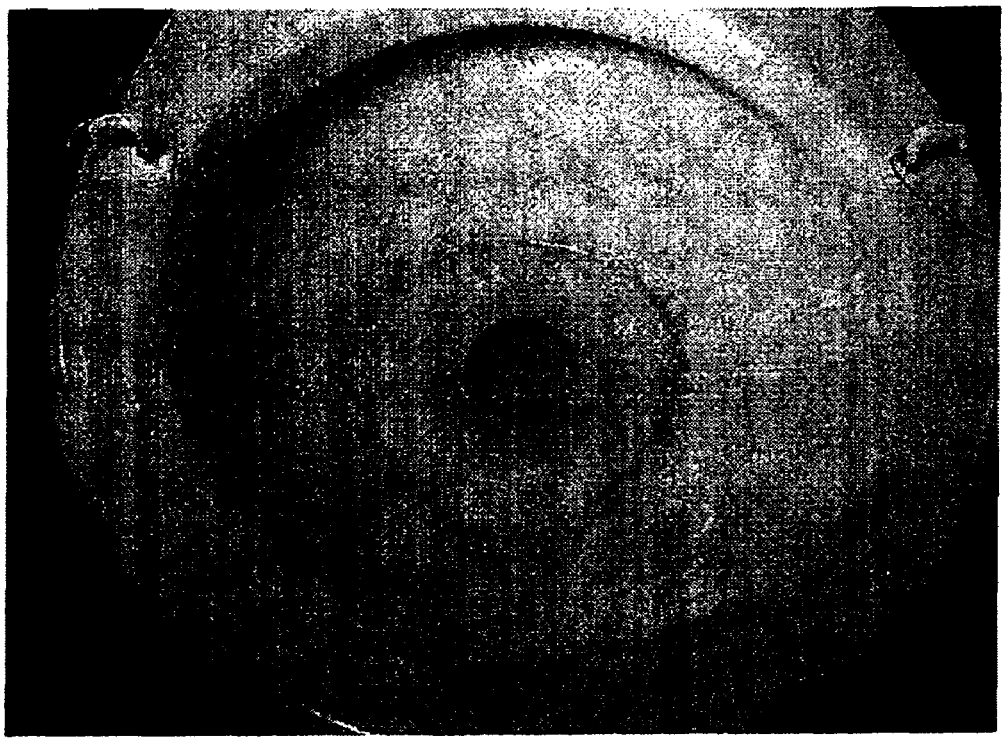
FIG. 7 is a photograph showing an iron stained vitreous surface (toilet bowl) after treatment with a commercial toilet bowl cleaner after 108 flushes.
Figure 8:
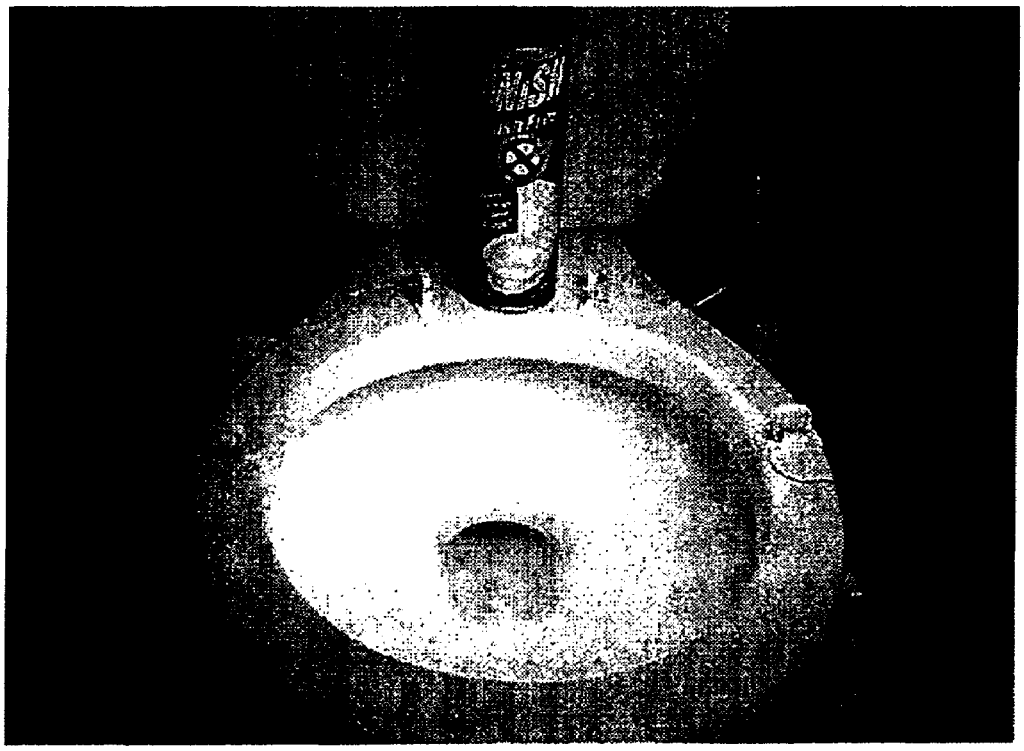
FIG. 8 is a photograph showing a clean vitreous surface (toilet bowl) after 108 flushes, in which the flush water has been softened and no treatment has occurred (Control).
Figure 9:
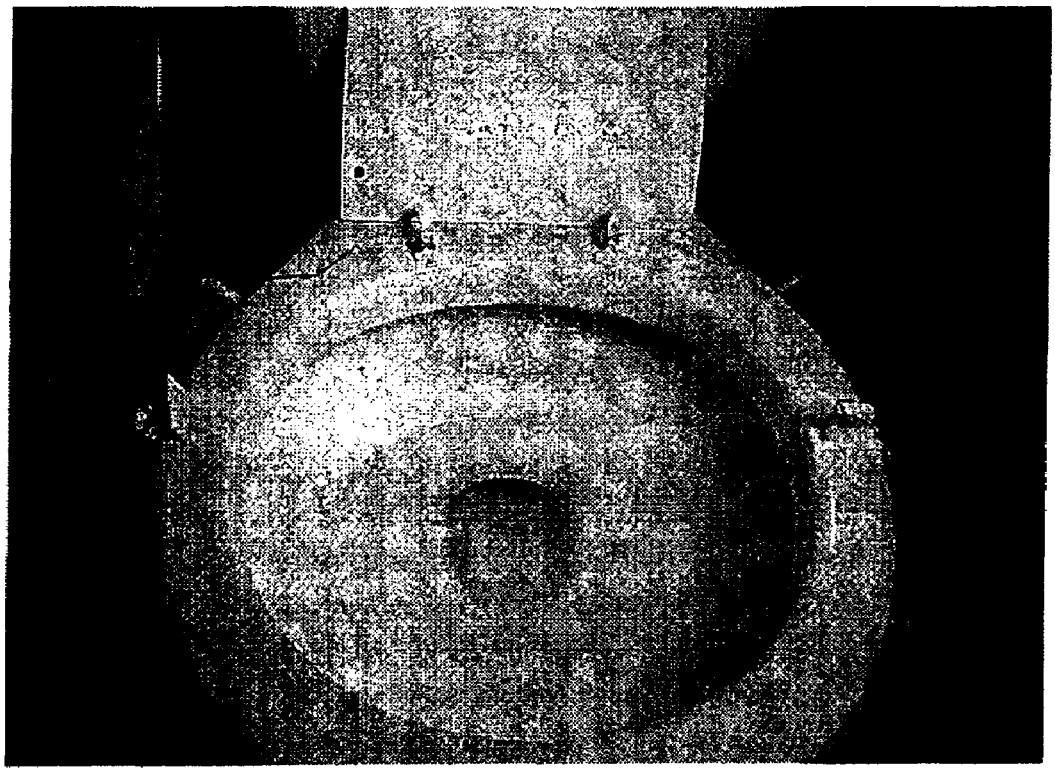

| Example | FIG. 1 (Invention) | FIG. 2 (Spike) | FIG. 3 (Commercial Product) | FIG. 4 (Control) |
|---|---|---|---|---|
| Appearance | No staining | Visible iron stains | Visible iron stains | No staining |
| Example | FIG. 5 (Invention) | FIG. 6 (Spike) | FIG. 7 (Commercial Product) | FIG. 8 (Control) |
| Appearance | No staining | Visible iron stains | Visible iron stains | No staining |

Considering the photographs FIGS. 1–8, it can be demonstrably seen that the Invention provides outstanding residual stain repellency after a single daily treatment.

TABLE III depicts an antimicrobial hard surface cleaner formula of the invention:

TABLE III

| Ingredient | Wt. % |
|---|---|
| Quaternary Ammonium Surfactant[1] | 0.3% |
| Glycol Ether[2] | 4.5 |
| Nonionic Surfactant[3] | 0.25 |
| Amine Oxide Surfactant[4] | 0.66 |
| Fluoropolymer[5] | 0.15 |
| Deionized Water | (balance) |

[1]Barquat MB-50, a $C_{14}$ alkylbenzyldimethylammonium chloride
[2]Ethylene glycol monobutyl ether
[3]Surfonic 610-3
[4]Barlox 12 (Stepan)
[5]Zonyl 8740; In the Control, there will be no fluoropolymer In the following Table IV, the unexpected accelerated dry times of the liquid hard surface cleaner were observed when the fluoropolymer was added. Each of the two liquid products (Control and Invention) were separately loaded to moist sponges and applied to black gloss tiles. Next, an abrasion tester wiped the surfaces of the black gloss tiles from $T_1$=start, in five cycles, then the tiles were observed until it was visually determined that the tile was completely free of liquid ($T_2$).

TABLE IV

| Example | Dry Time (seconds) |
|---|---|
| Control | 57.6 |
| Invention (+fluoropolymer) | 35.6 |
| LSD | 8.10 |

This demonstrates the unobvious drying time benefit when using fluoropolymers. The dry time was unexpectedly improved by at least 45%, but an increased dry time of at least 10% is also beneficial.

In the next set of examples, a glossy surface cleaner was prepared as in Table V:

TABLE V

| Ingredient | Wt. % |
|---|---|
| Isopropyl Alcohol | 5.0% |
| Ethylene Glycol Monobutyl Ether | 2.5% |
| Alkylpolyglycoside (Glucopon 425)[1] | 1.0% |
| Fluoropolymer[2] | 0.15% |
| Alkylpyrrolidone[3] | 0.02% |

TABLE V-continued

| Ingredient | Wt. % |
|---|---|
| Fragrance | 0.05% |
| Water | q.s. |

[1]nonionic surfactant (Henkel KgaA)
[2]Zonyl 8740; In the Control, there will be no fluoropolymer
[3]nonionic surfactant In the following examples, cleaning performance of the inventive product versus the Control (The Control is a commercial glass and hard surface cleaner which does not container polymer) were tested, along with the filming/streaking attributes. In the cleaning performance test, the products were tested against two different soils (greasy soil and kitchen soil, both of which are fabricated soils) which were applied to tiles and then, using a proprietary cleaning device which cleans and measures cleaning by measuring the integrated areas under a cleaning profile curve, which is the cumulative amount of soil removed at each cycle. The higher the score, the better, although scores within error may not actually be statistically different. In the filming/streaking test, clean black tiles had a small amount of product sprayed thereon, were allowed to dry completely and then were visually graded by an expert panel of over ten panelists. This was a blind test, in which the panelists did not know the identity of the products used to clean each black tile. They then graded each tile on a 0 to 10 scale, with 0 being dirty and 10 being completely clean and streak free. The results for both tests are depicted in TABLE VI:

TABLE VI

| Product | Greasy soil | Floor Soil | | Filming/Streaking |
|---|---|---|---|---|
| Control | 1,827 | 2,017 | | 6 |
| Invention | 1,500 | 1,884 | | 8.4 |
| Error (HSD) | 618 | 297 | Error (LSD) | 2 |

The results demonstrate that, although the cleaning performances for the Invention seem numerically less than those for the Control, they are certainly within error and therefore are not statistically different than the Control scores. On the other hand, the filming/streaking performance of the Invention is definitively superior to that of the Control.

The invention is further illustrated without limitation to scope and equivalents by the claims which follow hereto:

What is claimed is:

1. An improved liquid aqueous hard surface cleaner, comprising:

(a) a water-dispersible fluoropolymer having a molecular weight of at least 5000 Daltons;

(b) a surfactant; wherein said surfactant comprises at least one quaternary ammonium compound; and (c) a chelating agent therefor;

with the balance, water, wherein the hard surface cleaner is in a liquid form selected from the group consisting of: an emulsion suspoemulsion, liquid crystal, isotropic system, structured liquid, foam, gel paste or mull, and a hard surface cleaned therewith is rendered repellant to staining by heavy metals.

2. The liquid aqueous hard surface cleaner of claim 1 wherein the fluoropolymer is present in an amount so as to render a surface treated therewith resistant to restaining.

3. The liquid aqueous hard surface cleaner of claim 2 wherein said surface is a vitreous surface.

4. The liquid aqueous hard surface cleaner of claim 1 wherein said surfactant is selected from the group consisting of anionic, nonionic, amphoteric, zwitterionic, cationic surfactants, and mixtures thereof.

5. The liquid aqueous hard surface cleaner of claim 4 wherein said surfactant is at least one nonionic surfactant.

6. The liquid aqueous hard surface cleaner of claim 1 further comprising at least one adjunct selected from the group consisting of solvents, additional surfactants, hydrotropes, thickeners, dyes, colorants, biocides, fragrances and mixtures thereof.

7. A method for imparting resistance to hard water staining to a vitreous surface, comprising contacting said vitreous surface with the hard surface cleaner of claim 1.

8. An improved liquid aqueous hard surface cleaner, comprising:

(a) a water-dispersible fluoropolymer having a molecular weight of at least 5000 Daltons;

(b) a surfactant; wherein said surfactant comprises at least one quaternary ammonium compound; and (c) a chelating agent therefor;

with the remainder, water, wherein the hard surface cleaner is in a liquid form selected from the group consisting of: an emulsion, suspoemulsion, liquid crystal, isotropic system, structured liquid, foam, gel paste or mull, and wherein the hard surface cleaner has at least 10% faster dry times than a comparable cleaner without a fluoropolymer and causes a hard surface cleaned therewith to be rendered repellant to staining by heavy metals.

* * * * *